United States Patent [19]

Kushner et al.

[11] 4,443,521

[45] * Apr. 17, 1984

[54] COATING ALLOY

[75] Inventors: Burton A. Kushner, Old Bethpage; Michael J. Jirinec, New Hyde Park, both of N.Y.

[73] Assignee: Eutectic Corporation, Flushing, N.Y.

[ * ] Notice: The portion of the term of this patent subsequent to Nov. 30, 1999 has been disclaimed.

[21] Appl. No.: 416,009

[22] Filed: Sep. 8, 1982

Related U.S. Application Data

[62] Division of Ser. No. 323,390, Nov. 20, 1981.

[51] Int. Cl.[3] ..... C22C 19/03

[52] U.S. Cl. ..... 428/679; 428/680; 428/937; 420/459

[58] Field of Search ..... 420/459, 453; 427/423; 428/680, 678, 937

[56] References Cited

U.S. PATENT DOCUMENTS

| | | | |
|---|---|---|---|
| 1,556,776 | 10/1925 | Flintermann | 420/459 |
| 2,404,248 | 7/1946 | Parker | 420/459 |
| 3,761,255 | 9/1973 | Migazaki et al. | 420/459 |
| 3,837,844 | 9/1974 | Makita et al. | 420/459 |
| 4,006,012 | 2/1977 | Kindlemann | 420/459 |

FOREIGN PATENT DOCUMENTS

| | | | |
|---|---|---|---|
| 57-41342 | 3/1982 | Japan | 420/459 |

*Primary Examiner*—L. Dewayne Rutledge
*Assistant Examiner*—John J. Zimmerman
*Attorney, Agent, or Firm*—Hopgood, Calimafde, Kalil, Blaustein & Judlowe

[57] ABSTRACT

Relates to a coating alloy consisting essentially by weight of up to about 0.1% C, about 3% to 30% Mo, up to about 3% Si, up to about 6% W, about 2.5% to 12% Ti, about 10% to 22% Fe, up to about 0.4% V, and the balance essentially nickel.

4 Claims, 4 Drawing Figures

COATING ALLOY

Figure 1:
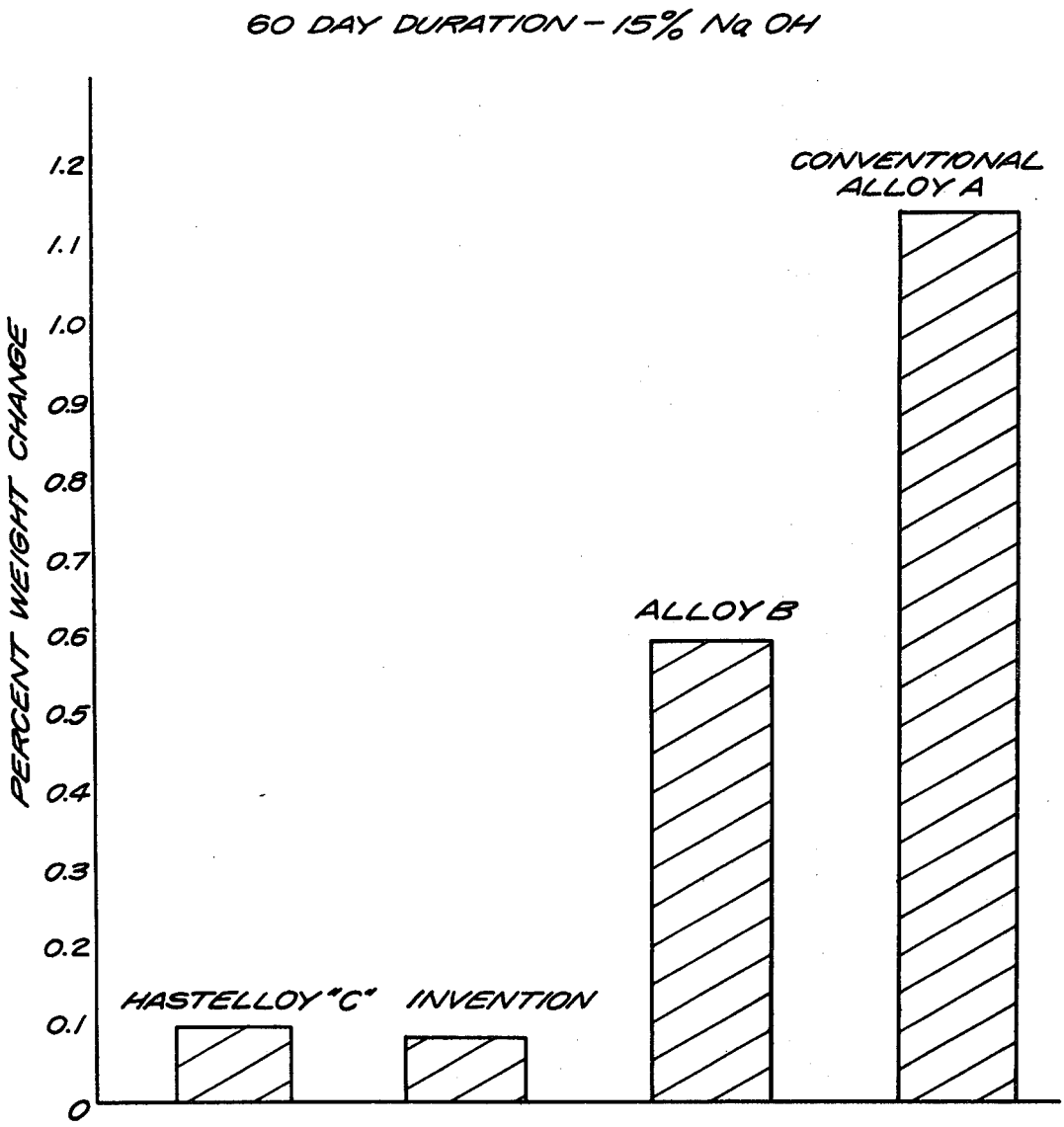

This is a division of application Ser. No. 323,390, filed Nov. 20, 1981.

This invention relates to a self-bonding frame spray alloy powder, otherwise referred to herein as a one-step flame spray powder.

RELATED APPLICATIONS

Reference is made to copending related applications Ser. No. 251,331 and Ser. No. 250,932 filed on Apr. 6, 1981, the disclosures of which are incorporated herein.

STATE OF THE ART

As pointed out in the aforementioned relates applications, it is known to coat metal substrates with a flame spray material to protect said metal substrates, such as a ferrous metal substrate, including steel and the like, and impart thereto improved properties, such as resistance to corrosion, and/or oxidation, and/or wear, and the like. The material sprayed, e.g., metals, may be in the form of a wire or a powder, powder spraying being a preferred method.

In order to provide a substrate with an adherent coating, it is the practice to clean the substrate and prepare the substrate by shot blasting it with steel grit or by threading the surface thereof on a lathe, if the shape is cylindrical, before depositing the metal coating thereon.

In U.S.Pat. No.3,322,515, a method is disclosed for providing an adherent coating onto a metal substrate by first cleaning the substrate and flame spraying a metal bond coat thereon using a flame spray powder in which elemental nickel and aluminum are combined together to form a composite particle, for example, a clad particle. This type of powder which is referred to in the trade as bond coat powder provides a basis layer by means of which a sprayed overlayer of other metals and alloys of substantial thickness is adherently bonded to the metal substrate. With this technique, fairly thick overlayers can be produced.

According to the patent, the nickel and aluminum in the composite particles are supposed to react exothermically in the flame to form an intermetallic compound (nickel aluminide) which gives off heat which is intended to aid in the bonding of the nickel-aluminum material to the metal substrate, the intermetallic compound forming a part of the deposited coating.

It is known in the patent literature to employ aluminum powder simply mixed with the particulate coating material to enhance the flame spraying thereof by using the heat of oxidation of aluminum which is substantially greater than the amount of heat released in the formation of the nickel aluminide intermetallic compound. A patent utilizing the foregoing concept is the Bradstreet U.S. Pat. No. 2,904,449 which discloses the use of a flame catalyst, e.g., aluminum, capable of catalyzing the oxidation reaction being carried out in the flame to thereby raise the flame temperature. Another patent along substantially the same line is Haglund U.S.Pat. No. 2,943,951.

In U.S. Pat. No. 4,230,750, a method is disclosed for producing an adherent coating using a flame spray powder mixture comprising: (1) agglomerates of a metallothermic heat-generating composition comprised essentially of fine particles of a reducible metal oxide formed from a metal characterized by a free energy of oxidation ranging up to about 60,000 calories per gram atom of oxidation referred to 25° C. intimately combined together by means of a thermally fugitive binder with fine particles of a strong reducing agent consisting essentially of a metal characterized by a free energy of oxidation referred to 25° C. of at least about 90,000 calories per gram atom of oxygen, (2) said agglomerates being uniformly mixed with at least one coating material selected from the group consisting of metals, alloys, and oxides, carbides, silicides, nitrides, and borides of the refractory metals of the 4th, 5th, and 6th Groups of the Periodic Table.

According to the patent, by employing a metallothermic heat-generating composition (i.e., a thermit mixture) in agglomerated form and simply mixing it with a coating material, e.g., nickel, among other coating materials, markedly improved bonding results are obtained as compared to using the agglomerated metallo-thermic composition alone followed by a sprayed overlayer.

By employing the metallo-thermic agglomerate, different flame characteristics are obtained which are conducive to the production of strongly adherent coatings.

In U.S. Pat. No. 4,039,318, a metaliferous flame spray material is disclosed, formed of a plurality of ingredients physically combined together in the form of an agglomerate, the plurality of ingredients in the agglomerate comprising by weight about 3% to 15% aluminum, about 2% to 15% refractory metal silicide and the balance of the agglomerate essentially a metal selected from the group consisting of nickel-base, cobalt-base, iron-base, and copper-base metals. A preferred combination is at least one refractory metal disilicide, e.g., $TiSi_2$ agglomerated with aluminum and nickel powder. The foregoing combination of ingredients provides metal coatings, e.g., one-step coatings, having improved machinability.

A disadvantage of using composite powders comprising elemental nickel and aluminum particles bonded together with a fugitive binder is that the coating obtained is not a completely alloyed coating as evidenced by the presence of free aluminum in the coating. Such coatings are not desirable for providing corrosion resistant properties.

It is known to produce coatings from alloy powders, particularly alloy powders in which one of the alloying constituents is a solute metal of a highly oxidizable metal, such as aluminum. A typical alloy is an atomized powder containing nickel as a solvent metal alloyed with 5% aluminum. Gas atomized powders are employed in that such powders, which are generally spherical in shape, are free flowing which is desirable for flame spraying. In order to assure bonding, relatively high flame spray temperatures are required. Thus, plasma torches are preferred in order to consistently produce coatings having the desired bond strength. The residence time during flight through the plasma or gas flame is very short and requires rapid heat absorption by the flame spray powder in order to reach the desired temperature. Thus, in the case of flame spraying with an oxyacetylene torch, it was not always possible to obtain consistently the desired bond strength, although such coatings were very desirable in that they were truly alloy coatings with the aluminum substantially dissolved in or pre-reacted with the solvent nickel.

THE RELATED APPLICATIONS

In the aforementioned related applications, Ser. No. 251,331 and Ser. No. 250,932, flame spray powders are disclosed and claimed derived from an atomized alloy powder in which the particles are characterized by aspherical shapes and which have an average particle size falling in the range of about 400 mesh to minus 100 mesh (U.S. Standard), e.g., about 35 to 150 microns, the aspherically shaped powder being further characterized by a specific surface of about 180 $cm^2/gr$ and higher, and generally about 250 $cm^2/gr$ and higher. By specific surface is meant the total surface area of particles per gram of the particles.

The alloy powders described are characterized by compositions consisting essentially of a solvent metal (e.g., iron-group metals and iron-group base alloys) of melting point in excess of 1100° C. whose negative free energy of oxidation ranges up to about 80,000 calories per gram atom of oxygen referred to 25° C. and contains at least one highly oxidizable solute metal as an alloying constituent in an amount of at least about 3% by weight, said oxidizable metal having a negative free energy of oxidation of at least about 100,000 calories per gram atom of oxygen referred to 25° C.

According to the aforementioned related applications, by employing randomly irregular aspherical powders having a specific surface of at least about 180 $cm^2/gr$, and preferably about 250 $cm^2/gr$ and higher, the powder is capable of high heat absorption during the short residence time in the flame, such that the particles striking the substrate are at the desirable temperature conducive to self-bonding. The presence of the highly oxidizable solute metal also aids in providing self-bonding characteristics.

The average particle size of the aspherical powder is controlled over the range of about 400 mesh to minus 100 mesh (about 35 to 150 microns) and preferably from about 325 mesh to 140 mesh (about 45 to 105 microns). The particles may be spherical gas-atomized powder which has been later flattened by ball milling so as to increase the specific surface; or the aspherical particles may be atomized powder formed by water, steam, or gas atomization, such that the ultimate powder has a randomly irregular aspherical shape of high specific surface.

The term "average size" means the average of the minimum and maximum size of the aspherical particles. For example, some of the particles may be less than about 400 mesh (less than about 35 microns) so long as the average size is over about 400 mesh. Similarly, some of the particles may be in excess of 100 mesh (in excess of about 150 microns) in size so long as the overall average size is 100 mesh or less.

Besides being aspherical, the powder should be free flowing so as to assure gravity feed to a torch. Thus, the apparent density of the powder and its size should not be so low as to lose its free-flowing characteristics.

Moreover, the average particle size should not fall substantially below 400 mesh, otherwise the alloy powder tends to oxidize and burn up in an oxyacetylene flame.

We have found that we can provide markedly improved bonding strength utilizing the aforementioned powder configuration and size, coupled with markedly improved resistance to corrosion, by employing a specific alloy powder composition of Ni-Mo-Fe containing substantial amounts of titanium.

OBJECTS OF THE INVENTION

It is an object of the invention to provide a corrosion-resistant alloy flame spray powder capable of producing adherent coatings on metal substrates characterized by improved bond strength.

Another object is to provide a method for flame spraying an adherent one-step coating using a self-bonding alloy flame spray powder.

Figure 2:
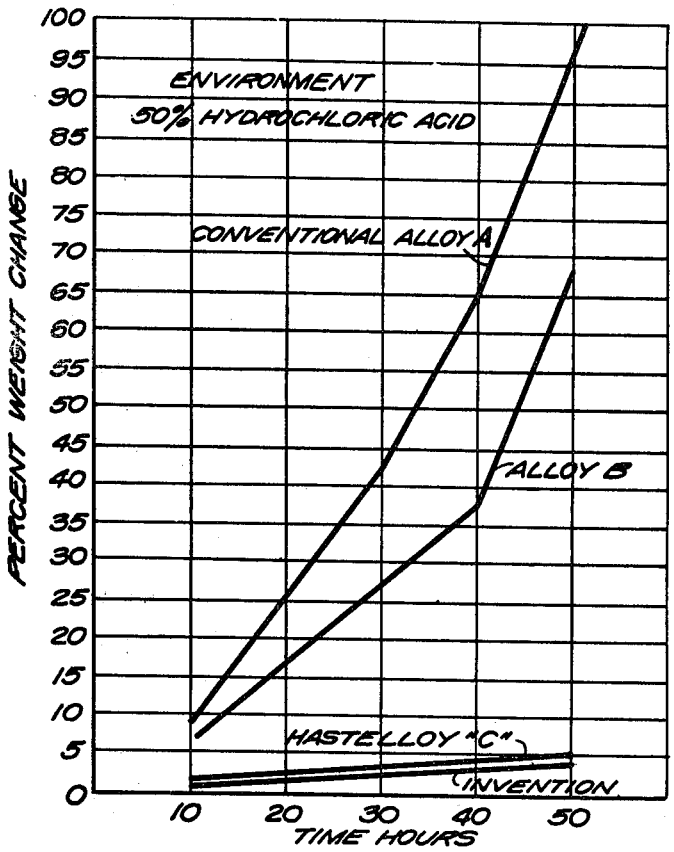
Figure 3:
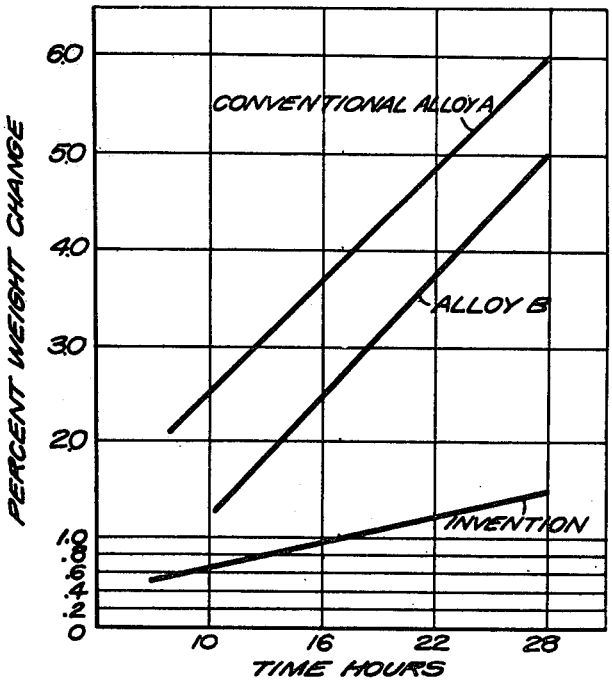
Figure 4:
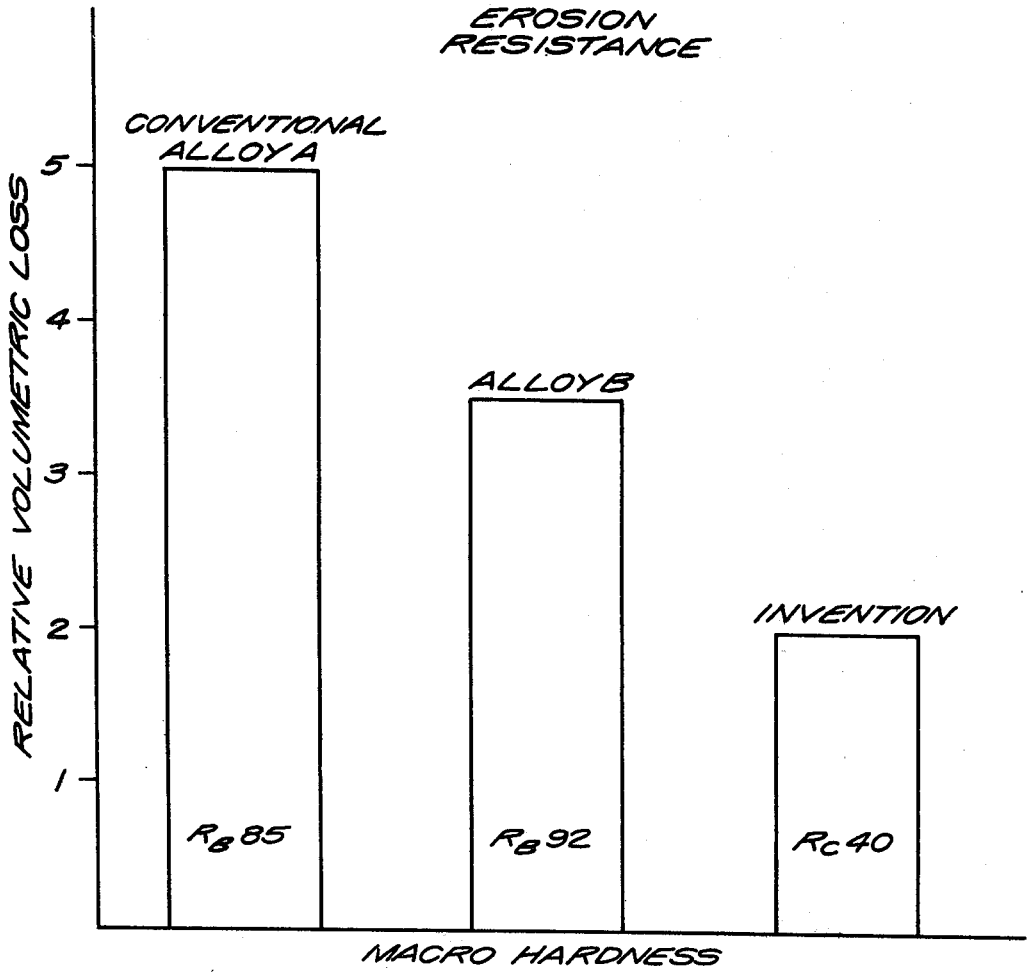

These and other objects will more clearly appear when taken in conjunction with the following disclosure, the appended claims, and the accompanying drawings, wherein:

FIGS. 1 to 3 are graphs comparing the corrosion resistance of the alloy of the invention with alloys outside the invention; and FIG. 4 is a graph comparing the erosion resistance of the flame spray alloy of the invention with alloys outside the invention.

THE INVENTION

Stating it broadly, the self-bonding flame-spray powder provided by the invention comprises a solvent alloy of Ni-Mo-Fe containing substantial amounts of the highly oxidizable solute metal titanium, the oxidizable metal being characterized by a negative free energy of oxidation of over 100,000 calories per gram atom of oxygen referred to 25° C.

In its broad aspects, the specific alloy has the following composition:

| Element | Range (% by Wt.) |
|---|---|
| C | up to about 0.1 |
| Mo | about 3 to 30 |
| Si | up to about 3 |
| W | up to about 6 |
| Ti | about 2.5 to 12 |
| Fe | about 10 to 22 |
| V | up to about 0.4 |
| Ni | essentially the balance. |

It is preferred that the alloy be chromium free, although up to about 5% by weight may be optionally present.

A more preferred composition of the alloy flame spray powder is as follows:

| Element | Range (% by Wt.) | Specific Alloy |
|---|---|---|
| C | about 0.02 to 0.035 | 0.033 |
| Mo | about 18 to 22 | 21.8 |
| Si | about 1.6 to 1.8 | 1.7 |
| W | about 3 to 6 | 4.5 |
| Ti | about 7 to 10 | 7.9 |
| Fe | about 17 to 20 | 17.3 |
| V | about 0.2 to 0.4 | 0.3 |
| Ni | essentially the balance | essentially the balance. |

Bonding strengths in the neighborhood of 5000 psi and above are obtainable with the aforementioned compositions. Generally speaking, bonding strengths may be at least about 2500 psi which is acceptable.

The importance of powder configuration in carrying out the purposes and aims of the invention has been confirmed by tests. As stated in the related applications, substantially spherical particles in the range of about 400 mesh to 100 mesh (about 35 microns to 150 microns) do not provide adequate specific surface to assure relatively high bonding strength. However, when the atomized particles are flattened, as by ball milling, the specific surface per gram of powder can be substantially increased. Substantially the same effect can be achieved by specially atomizing the alloy by water or high pressure steam in a manner conducive to the production of randomly irregular aspherical particles characterized by a high specific surface.

Thus, in the case of water atomization, the conditions are easily determined by setting the pressure and flow rate of the fluid according to nozzle design so as to produce turbulent forces which override the normal sphere-forming surface tension forces acting on the molten particle. An advantage of water atomization is its high quenching rate capability which causes the particles to freeze rapidly into irregular aspherical shapes. In the case of gas atomization, cool gases may be employed.

The particles flattened by ball milling are deemed to be disc-shaped, although it will be appreciated that the particles may take on a slightly eliptical shape.

The average particle size of the flame spray powder should range from 400 to 100 mesh (about 35 to 150 microns). As stated in the copending applications, the usable powder of high specific surface (of substantially over 180 $cm^2/gr$) are those powders whose particle size, following flattening, ranges from about 42 to 126 microns (or about 325 to 120 mesh). The desired particles of flattened configuration are obtained by sieving to provide sizes in the range of approximately 325 to 120 mesh (e.g., over 42 to about 125 microns), these powders being derived from gas-atomized alloy powders.

The flame spray powder of the invention produced from atomized powders are characterized as having free-flowing properties for use in flame spray torches, such as oxyacetylene torches of the type disclosed in U.S. Pat. No. 3,986,668 and 3,620,454, among others, depending on the feed rate employed and energy capacity of the torch. The powder of the invention is particularly useful in plasma spraying.

By using aspherical powder of the composition disclosed herein in accordance with the invention, relatively high bonding strengths in excess of about 2500 psi are obtainable as measured in accordance with ASTM C633-69 Procedure.

According to the ASTM Procedure, the determination is made by using a set of two cylindrical blocks one inch in diameter and one inch long. An end face of each block of the set is ground smooth and one face first coated with the aformentioned bond coat compositions by flame spraying to a thickness of about 0.008 to 0.012 inch. A high strength overcoat is applied to the first coat, the high strength overcoat being, for example, a nickel-base alloy known by the trademark Inconel (7% Fe - 15% Cr - balance Ni) or a type 431 stainless steel (16% Cr and the balance iron). The thickness of the high strength overcoat is about 0.015 to 0.020 inch; and after depositing it, the overall coating which has a thickness ranging up to about 0.025 inch is then finished ground to about 0.015 inch. A layer of epoxy resin is applied to the overcoat layer, the epoxy layer having a bond strength of over 10,000 psi.

The other block of the set is similarly end ground to a smoothness corresponding to 20 to 30 rms and a layer of high strength epoxy resin applied to it. The two blocks of the set are assembled together by clamping one with the metal coating and the epoxy layer to the other with the epoxy faces of the blocks in abutting contact and the clamped blocks then subjected to heating in an oven to 300° F. (150° C.) for one hour, whereby the epoxy faces strongly adhere one to the other to provide a strongly bonded joint.

The joined blocks are then pulled apart using anchoring bolts coaxially mounted on opposite ends of the joined blocks using a tensile testing machine for recording the breaking force. The bonding strength is then determined by dividing the force obtained at failure by the area of the one inch circular face of the blocks.

As illustrative of the invention, the following example is given:

EXAMPLE 1

A bonding test was conducted on flame-sprayed atomized irregular particles comprising Ni-Mo-Fe containing 7.9% titanium. The powder had an approximate average size ranging from about 325 mesh to 140 mesh (about 45 to 105 microns), was free flowing, and exhibited an average specific surface substantially in excess of 250 $cm^2/gr$. The powder was flame sprayed using a commercial plasma spray torch well known in the art.

The powder was fed at a rate of about 5 to 6 lbs./hour and was deposited on a substrate of 1020 steel. The bond strength was measured in accordance with ASTM C633-69 as described herein-above. The surface area of the powder was determined using the BET method. The bonding characteristics of the powder relative to the specific surface and the composition is as follows:

TABLE 1

| POWDER TYPE | COMPOSITION | SURFACE AREA | BOND STRENGTH |
|---|---|---|---|
| Atomized irregular particles | 0.033 C<br>21.8 Mo<br>17.3 Fe<br>1.7 Si<br>4.5 W<br>0.3 V<br>7.9 Ti<br>Bal. Ni | 3400 $cm^2/gr$ | 7800 psi |

As is clearly apparent from the table, the powder composition tested exhibited very high bonding strength. Broadly speaking, the composition provides high bonding strengths of over about 3000 psi and typically at least about 500 psi.

An important property of sprayed coatings is the ability of the coating to resist corrosion. Another important property is the resistance to erosion.

The markedly improved properties of the alloy of the invention will be clearly apparent from FIGS. 1 to 4. The sprayed coatings for the corrosion tests were produced on a surface in such a way as to enable the entire coatings to be stripped off to provide test specimens for the test. The erosion tests were conducted on coatings bonded strongly to a mild steel substrate.

The nominal compositions of the alloys tested are as follows:

TABLE 2

| METAL COATING | % C | % Al | % Mo | % Cr | % Fe | % Si | % W | % V | % Ti | % Ni |
|---|---|---|---|---|---|---|---|---|---|---|
| Invention | 0.033 | — | 21.8 | — | 17.3 | 1.7 | 4.5 | 0.3 | 7.9 | bal. |
| Hastelloy C | 0.02 | — | 16.9 | 16.5 | 6.3 | 0.4 | 4.6 | — | — | bal. |
| Alloy A* | — | 7.0 | 5.5 | 9.0 | 5.0 | — | — | — | — | bal. |

TABLE 2-continued

| METAL COATING | % C | % Al | % Mo | % Cr | % Fe | % Si | % W | % V | % Ti | % Ni |
|---|---|---|---|---|---|---|---|---|---|---|
| Alloy B** | — | 9 | 5 | 9 | 7 | — | — | — | — | bal. |

*This alloy is a conventional alloy which is produced by spraying a composite powder.
**This alloy is produced from an atomized irregularly shaped powder.

The corrosion test illustrated in FIG. 1 is a 60-day duration test run in a 15% sodium hydroxide solution. Samples of the four alloys were exposed in this solution and the percent weight change recorded for the test period. As will be noted, the alloy of the invention had the lowest percentage weight change with Hastelloy "C" a close second. However, a disadvantage of Hastelloy "C" alloy is that it is difficult to spray bond it to a metal substrate in a one-step spraying operation without using an intermediate bond coat. In a one-step spray bonding test, the alloy of the invention provided a bonding strength of approximately 8000 psi; whereas, Hastelloy "C" sprayed under the same conditions did not adhere, the bonding strength being less than 500 psi. Thus, the alloy of the invention is superior to all three alloys.

The test result shown in FIG. 2 was conducted in a solution of 50% hydrochloric acid for approximately 50 hours. Again, the alloy of the invention was superior. While Hastelloy "C" gave good results, its main disadvantage is its very poor as-sprayed bonding strength. The same corrosion trend was indicated even after 86 hours. This is a highly accelerated test.

The test of FIG. 3 is similar to that of FIG. 2 except that the specimens were tested in a vapor of 50% hydrochloric acid (azeotrope of the acid), the alloy being superior to both the conventional Alloy A and Alloy B.

The erosion test results illustrated in FIG. 4 were obtained by employing a blast erosion test, the same test being employed under the same conditions for each of the coating alloys using a predetermined amount of grit. As stated hereinabove, each of the alloys were bonded to a mild steel substrate. The greater the amount of material removed, the lower the resistance to erosion. As will be noted, the alloy of the invention is superior to conventional Alloy A and to Alloy B.

Free-flowing characteritics of the flame spray powder are important. The desirable free-flowing characteristics are those defined by the flow through a funnel which provides a flow rate, such as the Hall Flow Rate.

The Hall Flow Rate device comprises an inverted cone or funnel having an orifice at the bottom of the funnel or cone of one-tenth inch diameter and a throat one-eighth inch long. Such a funnel is illustrated on page 50 of the Handbook of Powder Metallurgy by Henry H. Hausner (1973, Chemical Publishing Co., Inc., New York, NY). The flow rate is the number of seconds it takes 50 grams of powder to pass through the opening of the funnel. A typical flow rate of a randomly irregular aspherical powder of the type illustrated in FIG. 2 is 30 to 33 seconds for 50 grams of powder having the following particle distribution:

| MESH | WT. % |
|---|---|
| +100 | 0 |
| +140 | 1.0 max. |
| +170 | 10.0 max. |
| +325 | bal. |
| −325 | 20.0 max. |

An advantage of producing a one-step alloy bond coat in accordance with the invention is that the deposited alloy coating is generally homogeneous and does not contain free unalloyed metal as does occur when spraying composite metal powders comprising agglomerates of, for example, elemental nickel and aluminum.

Although the present invention has been described in conjunction with preferred embodiments, it is to be understood that modifications and variations thereto may be resorted to without departing from the spirit and scope of the invention as those skilled in the art will readily understand. Such modifications and variations are considered to be within the purview and scope of the invention and the appended claims.

What is claimed is:

1. A metal substrate having bonded thereto a flame-sprayed coating formed of an alloy consisting essentially by weight of up to about 0.1% C, about 3% to 30% Mo, up to about 3% Si, up to about 6% W, about 2.5% to 12% Ti, about 10% to 22% Fe, up to about 0.4% V, and the balance essentially nickel.

2. The flame-sprayed coating of claim 1, wherein the alloy consists essentially of about 0.02% to 0.035% C, about 18% to 22% Mo, about 1.6% to 1.8% Si, about 3% to 6% W, about 7% to 10% Ti, about 17% to 20% Fe, about 0.2% to 0.4% V, and the balance essentially nickel.

3. An alloy consisting essentially by weight of about 0.2% to 0.035% C, about 18% to 22% Mo, about 1.6% to 1.8% Si, about 3% to 6% W, about 7% to 10% Ti, about 17% to 20% Fe, about 0.2% to 0.4% V, and the balance essentially nickel.

4. The alloy of claim 3, wherein said alloy contains up to about 5% Cr.

* * * * *

UNITED STATES PATENT AND TRADEMARK OFFICE

CERTIFICATE OF CORRECTION

PATENT NO. : 4,443,521

DATED : April 17, 1984

INVENTOR(S) : Burton A. Kushner and Michael J. Jirinec

It is certified that error appears in the above-identified patent and that said Letters Patent are hereby corrected as shown below:

Column 8, claim 3, line 2 of the claim, change the range of "0.2% to 0.035% C" to --0.02% to 0.035% C--.

Signed and Sealed this

*Ninth* Day of *October 1984*

[SEAL]

*Attest:*

GERALD J. MOSSINGHOFF

*Attesting Officer*

*Commissioner of Patents and Trademarks*